US005450861A

United States Patent [19]

Colani

[11] Patent Number: 5,450,861

[45] Date of Patent: Sep. 19, 1995

[54] MANUAL FILLING DEVICE FOR CIGARETTE TUBES, PARTICULARLY FOR CIGARETTE FILTER TUBES

[75] Inventor: Luigi Colani, St. Paul, France

[73] Assignee: EFKA-Werke Fritz Kiehn GmbH, Germany

[21] Appl. No.: 20,201

[22] Filed: Feb. 19, 1993

[30] Foreign Application Priority Data

Feb. 20, 1992 [DE] Germany ..... 42 05 217.3
Mar. 6, 1992 [DE] Germany ..... 42 07 196.8

[51] Int. Cl.[6] ..... A24C 5/42; A24C 5/06
[52] U.S. Cl. ..... 131/70; 131/72
[58] Field of Search ..... 131/70–72

[56] References Cited

U.S. PATENT DOCUMENTS 3,699,975 10/1972 Saraber ..... 131/70
3,741,220 6/1973 Meinunger ..... 131/70

FOREIGN PATENT DOCUMENTS

0556860A1 2/1993 European Pat. Off. .
2059201 5/1971 France .
211462 12/1907 Germany ..... 131/70
2021738 4/1973 Germany .
4207196 12/1993 Germany .

*Primary Examiner*—Jennifer Bahr

*Attorney, Agent, or Firm*—Andrus, Sceales, Starke & Sawall

[57] ABSTRACT

A manual filling device for cigarette tubes, comprising a tobacco compression chamber extending in longitudinal direction of said device and being defined by a housing (12) disposed in a bottom part (14). A pressing bar (16) is provided on a lid (18) which is hinged to the housing (12) and covers said housing (12). A spoon (20) and an ejector slide (22) is provided for ejecting a compressed tobacco bar from the tobacco compression chamber through an opening (24) formed in said housing (12) into a cigarette (filter) tube. A clamping member (59) clampingly retains the cigarette tube on a socket piece disposed at the exit from the tobacco compression chamber. A locking or snap-in unit (60) releasably connects said housing (12) and said lid (18), and includes a substantially hook-shaped detent (62) provided on an elastic web (78) joined to the free end (64) of the lid (18) opposite the hinged connection (34) between lid (18) and housing (12). The detent is adapted to be engaged with a locking protrusion (66) formed on the housing (12). The detent (62) is provided on an elastic web (78) which in its turn is joined through a second elastic web (75) to the free end (64) of the lid (18). The second web includes a free end (77) with an actuating lever (76) for lifting the detent (62) off the locking protrusion (66) to thereby facilitate disengagement and/or engagement of the locking or snap-in unit (60).

16 Claims, 5 Drawing Sheets

MANUAL FILLING DEVICE FOR CIGARETTE TUBES, PARTICULARLY FOR CIGARETTE FILTER TUBES

BACKGROUND OF THE PRESENT INVENTION

The present invention is concerned with a manual filling device for cigarette tubes, particularly for cigarette filter tubes.

Such a manual filling device for cigarette tubes, particularly for cigarette filter tubes, comprising a tobacco compression chamber extending in longitudinal direction thereof has been known from DE Patent Specification 2,021,738. The tobacco compression chamber of this manual filling device is substantially constituted by a housing disposed in the bottom portion and by a compressing bar which is provided on a lid covering the housing and hingedly mounted thereto. Also, the tobacco compression chamber of the known manual filling device is defined by a spoon as well as an ejector slide for ejecting a compressed tobacco bar from the tobacco compression chamber via an opening formed in the housing into a cigarette (filter) tube. Furthermore, the known manual filling device comprises a clamping unit for clampingly retaining the cigarette (filter) tube on a socket piece disposed at the exit from the tobacco compression chamber. Finally, the known manual filling device also comprises a locking or snap-type or similar locking mechanism for releasably connecting housing and lid, the mechanism including a substantially hook-like detent provided on an elastic web joined to the free end of the lid opposite the hinged connection between lid and housing, detent adapted to be engaged with a locking protrusion provided on the housing. The detent extends approximately in the direction of the hinged connection between lid and housing while the locking protrusion extends approximately in a direction opposite thereto.

A significant drawback of the known manual filling device for cigarette tubes, particularly cigarette filter tubes, is the handling thereof during the actual filling operation. On the one hand, a certain force is required prior to the actual filling operation in order to bring the detent, which is disposed on the free end of the lid, into mutual operational engagement with the locking protrusion correspondingly provided on the housing. On the other hand, therefore, following the actual filling operation some effort or skill on the user's part is required for disengaging the detent disposed on the free end of the lid from the locking protrusion connected to the housing. Any raising of the detent off the locking protrusion and hence any disengagement and/or engagement of the locking or snap-type or similar means is made more difficult due to the lack of a handle or the like and on account of the confined space due to the ready-filled cigarette which is still clamped to the socket piece. Hence, due to carelessness, undue haste or the like on the part of the user of this manual filling device the lid may be raised off the housing only abruptly and with some effort. But this frequently results in unexpected dropping of the ready-filled cigarette. In this respect the known manual filling device requires much effort and is inconvenient. Also, the relatively high net weight of the known manual filling device constitutes another drawback. In order to obtain a stable overall structure by means of which a sufficient pressing force may be applied on the tobacco within the tobacco compression chamber for insertion into the respective cigarette (filter) tube, the bottom part, housing and lid of this manual filling device are largely made of solid material. Because of the resultant high net weight of almost 100 g the known manual filling device is relatively unwieldy for use when taken along.

SUMMARY OF THE INVENTION

Starting out from the prior art it is the objective of the present invention to provide a manual filling device for cigarette tubes, particularly for cigarette filter tubes which is simple and safe to handle during the actual filling operation while it has an extremely light-weight and yet sturdy structure.

The present invention as applied to a device as disclosed in the above German patent 2,021,738 is formed with a easy and uncomplicated operating system as well as rapid lifting of the detent off the locking protrusion is enabled due to the construction of an elastic web, which in accordance with the invention, is provided on the free end of the lid having the prior art elastic web comprising the detent joined thereto the special web is formed including an operating lever on the free end thereof. It is thereby possible to considerably facilitate the disengagement and/or engagement of the locking or snap-in or similar mechanism. Handling of the manual filling device according to the invention may be achieved without any special expenditure of force or any special skill or attention on the user's part towards preventing dropping of the ready-filled cigarette from the socket piece after the locking or snap-type or similar device has been released. The manual filling device according to the present invention is therefore very easy and safe to handle. Also, the manual filling device of the present invention is of light-weight and yet sturdy construction.

Structural details of the manual filling device of the present invention are further described hereinafter and defined in the claims.

Thus, further features are very important for further simplified handling. Thus, due to the embodiment of the locking or snap-type or similar means in accordance with the invention it is possible prior to the actual filling operation, i.e. prior to ejection of the tobacco from the tobacco compression chamber into the prepared cigarette (filter) tube clampingly retained on the socket piece, to achieve simple locking of the detent or the like provided on the lid within the locking protrusion or the like formed on the housing. The same applies to the subsequent disengagement or release etc. of the detent or the like on the lid from the locking protrusion or the like provided on the housing after completion of the actual filling operation, i.e. when the tobacco has been filled completely into the respective cigarette (filter) tube. At the same time it is possible due to the configuration of the locking or snap-type or similar means according to the invention to achieve an effective connection between housing and lid during the actual filling step, i.e. a connection which is safe from automatic disengagement.

An improvement as regards the handling of the manual filling device of the present invention is only provided with the special web or the like extending substantially vertically upwardly and which is largely rigid and practically serves as a counter support for the web or the like which is to serve as an operating lever and which extends beyond the free end of the lid and preferably in upward direction.

Furthermore, in one arrangement of the invention, the clamping piece serves as the clamping means, both the fixing and the subsequent release of the cigarette (filter) tube, which is to be filled or is being filled with tobacco, to and from the socket piece are respectively coupled with the functional engagement of the locking or snap-in or similar means. Any dropping or loosening of the cigarette (filter) tube being filled with tobacco during the actual filling operation is effectively prevented thereby. Accordingly, the user of the manual filling device of the present invention need not be particularly careful to retain the cigarette (filter) tube to be filled with tobacco when the lid has been locked with or snapped into the housing or the like, etc. Also, the structural embodiment obtained is especially simple.

Moreover, within the scope of the present invention, the housing is disposed in the bottom part for longitudinal movement therein, the ejector slide being secured to the bottom part and supporting the spoon. This results in an improved overall design of the manual filling device of the present invention, which is simple while exhibiting extremely high stability.

Further special structure is essentially concerned with securing the housing having the lid hinged thereto, with the housing being accommodated in the bottom part for longitudinal movement therein. In this way an automatic longitudinal movement of the housing with the lid inside the bottom part, i.e. any such longitudinal movement which is not intended on the part of the user of the manual filling device, is substantially prevented.

Finally, special features are disclosed which are advantageous in respect of a reduction in weight of the manual filling device of the present invention, while the stability of the device is in no way affected thereby. Thus, the overall weight of the manual filling device of the invention may be reduced by one-third to one-half of the net weight of the conventional manual filling device.

BRIEF DESCRIPTION OF THE DRAWINGS

Further features, advantages and details of the present invention will become apparent from the following description of a preferred embodiment of the invention with reference to the drawing, in which.

DESCRIPTION OF THE ILLUSTRATED EMBODIMENT

Figure 1:
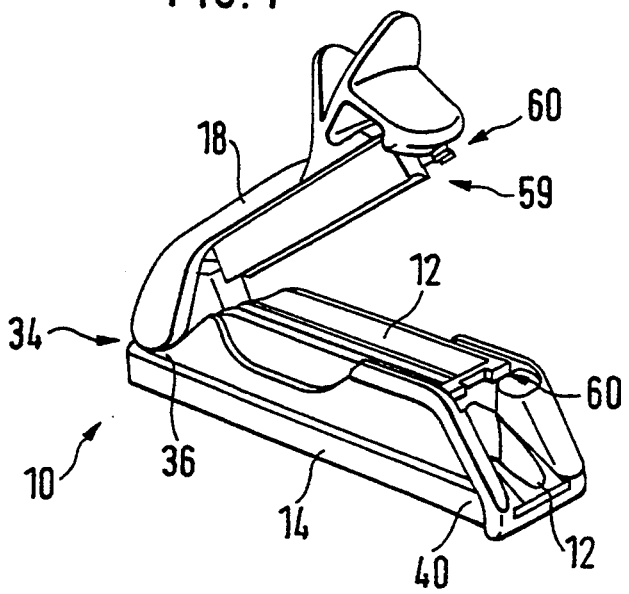
FIG. 1 is a perspective view of an embodiment of a manual filling device designed in accordance with the present invention with the lid partly open.
Figure 2:
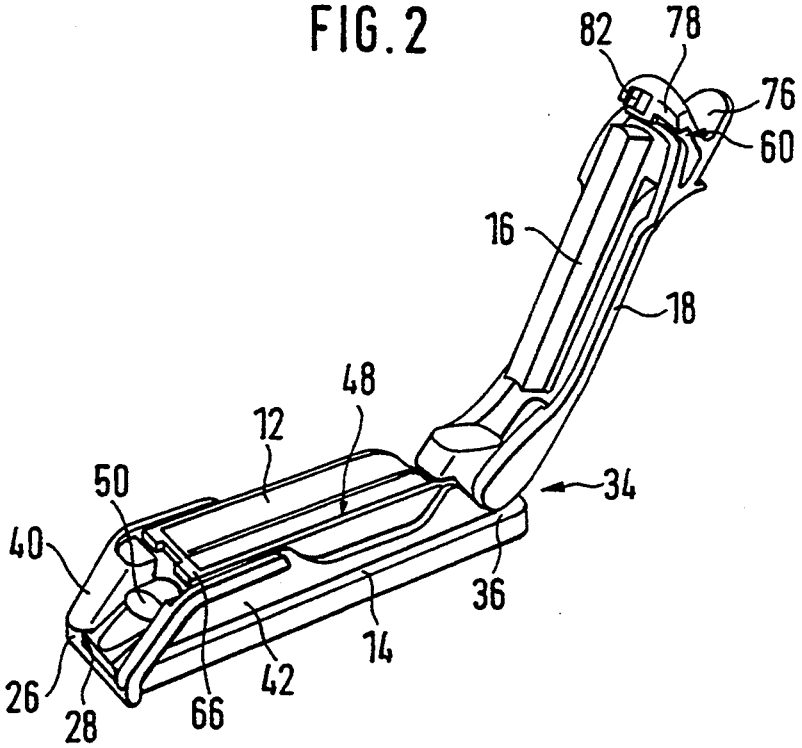
FIG. 2 is a perspective view of an embodiment of the manual filling device of the present invention as illustrated in FIG. 1, with the lid being opened still further.
Figure 3:
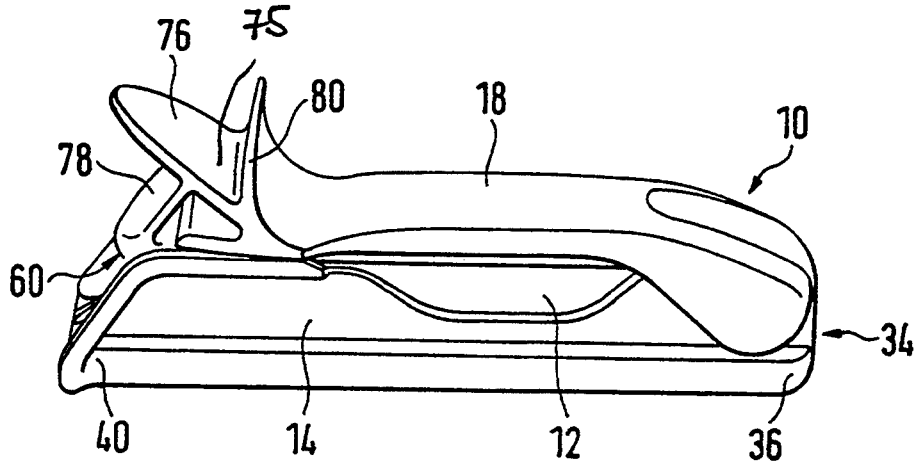
FIG. 3 is a side view of an embodiment of the manual filling device of the present invention as illustrated in FIGS. 1 and 2, with the lid in the closed state.
Figure 4:
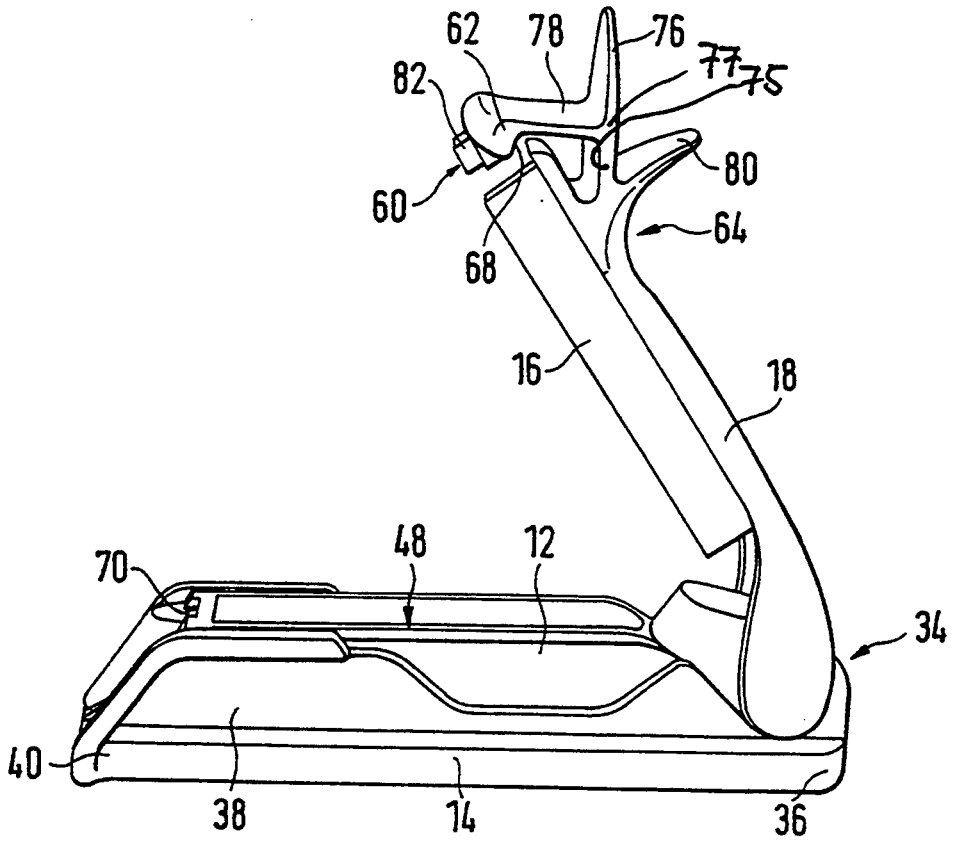
FIG. 4 is a side view of an embodiment of the manual filling device of the present invention as illustrated in FIGS. 1 to 3, with the lid partly opened.
Figure 5:
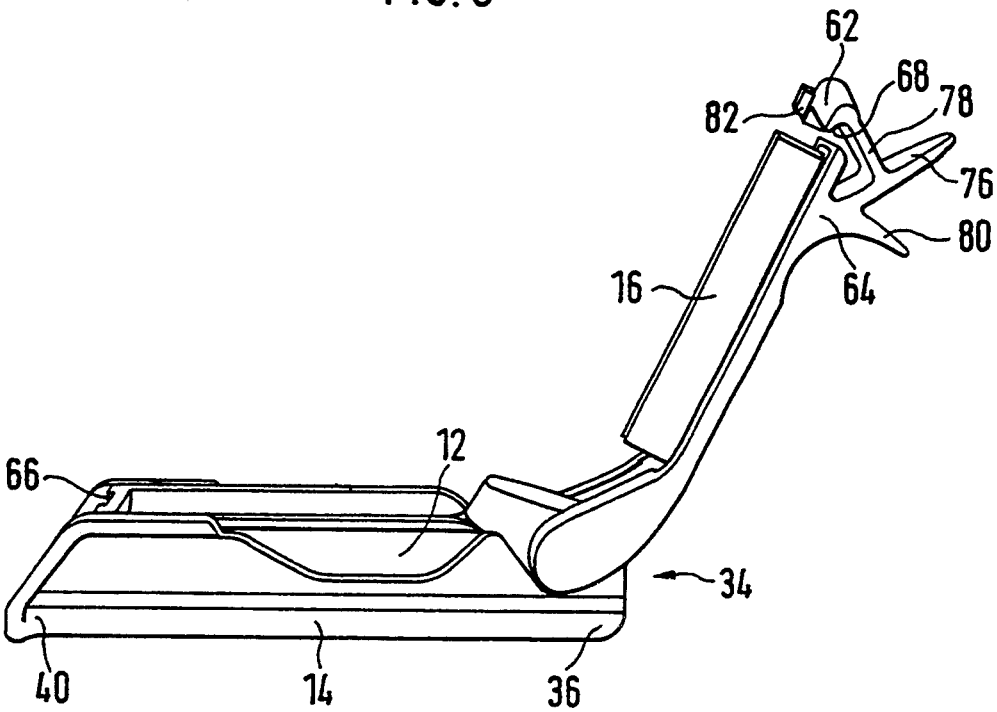
FIG. 5 is a side view of an embodiment of the manual filling device of the present invention as illustrated in FIGS. 1 to 4 with the lid opened still further.

FIGS. 1 to 5 illustrate a manual filling device 10 of the present invention for cigarette tubes (not illustrated), particularly for cigarette (filter) tubes (not illustrated), comprising a tobacco compression chamber extending in longitudinal direction of the manual filling device 10.

The tobacco compression chamber is constituted by a housing 12 which is disposed within a bottom part 14 for longitudinal movement therein. Furthermore, the tobacco compression chamber is defined by a pressing bar 16 which is provided on a lid 18 intended to cover the housing 12 and hingedly connected thereto. Furthermore, the tobacco compression chamber is defined by a spoon 20 and an ejector slide 22 for ejecting a compressed tobacco bar from the tobacco compression chamber via an opening 24 formed in the housing 12 into a cigarette (filter) tube. The ejector slide 22, which is mounted on the bottom part 14, carries the spoon 20.

The bottom part 14, which has approximately U-shaped cross-section (see especially FIG. 10), comprises two undercut portions 26 for accommodating two correspondingly shaped guide fins 28 of the housing 12. In this way the housing 12 can be reciprocated within the bottom part 14 exclusively in longitudinal direction of the manual filling device 10.

Figure 7:
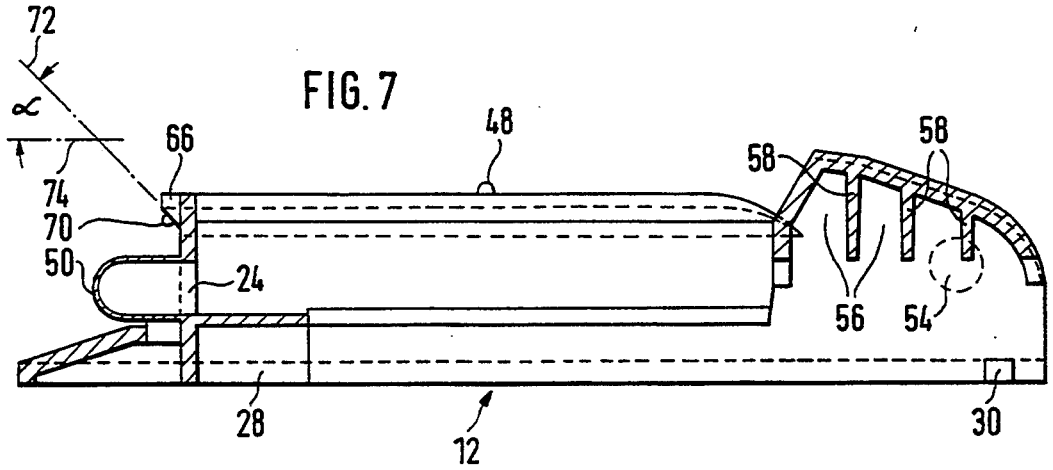
FIG. 7 is an enlarged central longitudinal section through an embodiment of a housing of the manual filling device as shown in FIGS. 1 to 5.
Figure 8:
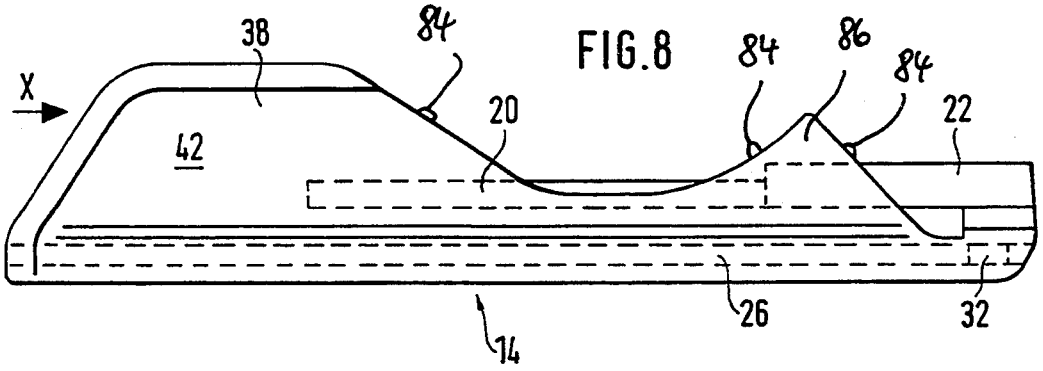
FIG. 8 is an enlarged side view of an embodiment of a bottom part of the manual filling device of the invention as shown in FIGS. 1 to 5.
Figure 9:
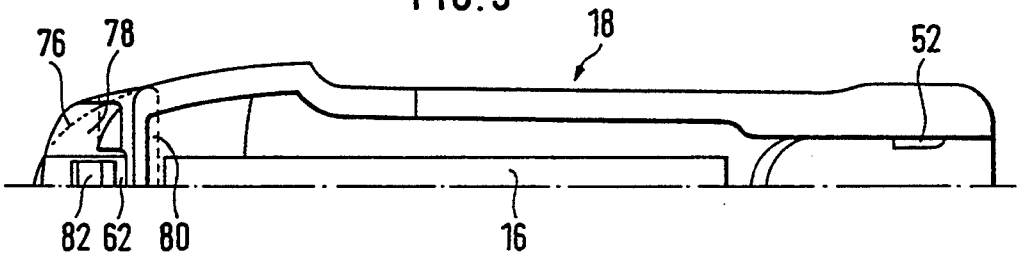
FIG. 9 is half a bottom view showing the embodiment of the lid according to FIG. 6.
Figure 10:
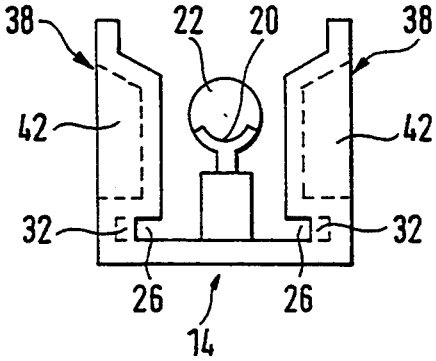
FIG. 10 is a front view of an embodiment of the bottom part along the arrow X of FIG. 8.

However, as will be apparent from FIGS. 7, 8 and 10 a locking units or the like is provided between the bottom part 14 and the housing 12, which is accommodated by the bottom part 14 for longitudinal movement therein, said locking units causing a certain sluggishness at the commencement of the actual filling operation when the housing 12 is moved longitudinally within the bottom part 14. In this way any automatic detachment of the housing 12 from the bottom part 14 is reliably prevented. In the instant case, the locking unit comprises at least a lateral protrusion 30 formed on at least one of the two guide fins 28 of the housing 12 accommodated by the undercut guide portion 26 of the bottom part 14. Advantageously, however, the lateral protrusion 30, which is provided on one of the two guide fins 28 of the housing 12, is adapted to be latched with a mating lateral recess 32 formed in the undercut portion or portions 26 of the bottom part 14 serving as guide means. Preferentially, the protrusion 30 formed on the guide fin 28 of the housing 12 and the recess 32 formed in the undercut portion 26 of the bottom part 14 are provided in the vicinity of the end 36 of the lid 18 or bottom part 14, said end 36 being near the hinged connection 34 between lid 18 and housing 12.

Furthermore, the two sidewalls 38 of the bottom part 14 of substantially U-shaped cross-section are provided with recessed grips 42 or the like in the vicinity of the end 40 of the bottom part 14 which is opposite to the hinged connection 34 between lid 18 and housing 12. The recessed grips 42 or the like offer a good hold particularly to the thumb and forefinger of the user during the actual filling operation, i.e. during the longitudinal movement of the housing 12 and the lid 18 hinged thereto within the bottom part 14. Any slippage during the actual filling operation is excluded thereby.

Figure 11:
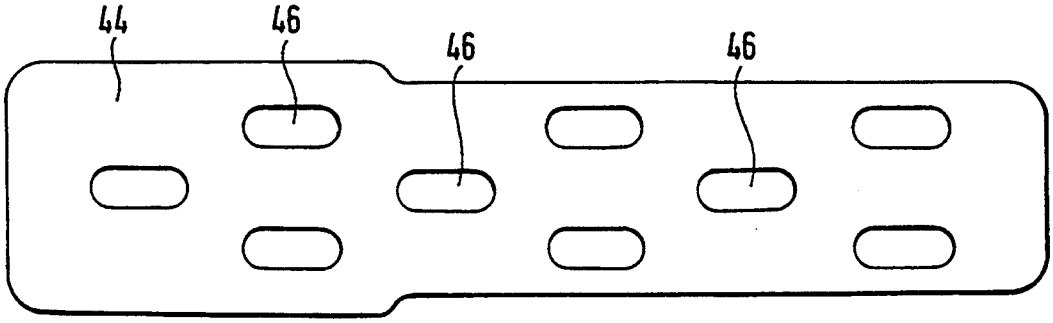
FIG. 11 is a view of the underside of an embodiment of the bottom part corresponding to FIG. 8.

As will be apparent from FIG. 11, the bottom wall 44 which interconnects the two sidewalls 38 of the bottom part 14 is provided with recesses 26 in order to save material and thus to reduce the weight of the manual filling device 10 as a whole. The ejector slide 22 carrying the spoon 20 is mounted, as shown in FIG. 8, in the vicinity of the end 36 of the bottom part 14 which is near the hinged connection 34 between lid 18 and housing 12.

For filling tobacco into the tobacco compression chamber the housing 12 comprises a charging opening 48, and for ejecting the compressed tobacco bar from the tobacco compression chamber it comprises an opening 24 with which a socket piece 50 is contiguous. The socket piece 50 is used to accommodate the cigarette (filter) tube which is to be filled with tobacco. Opening 24 and socket piece 50 are disposed in the vicinity of the end 40 of the bottom part 14 which is opposite to the hinged connection 34 between lid 18 and housing 12. Here, hinging of the lid 18 to the housing 12 is effected by two laterally outwardly extending circular bosses 52 formed in the lid 18 which engage in correspondingly sized holes 54 formed on the housing 12. The housing 12 is provided with recesses 56, preferentially in the vicinity of the hinged connection 34, so as to reduce the weight of the manual filling device 10. At the same time, stiffening ribs 58 provide for high stability and strength of the manual filling device 10.

Furthermore, the manual filling device 10 comprises clamping unit 59 for clampingly retaining the cigarette (filter) tube on the socket piece 50 disposed at the exit from the tobacco compression chamber, and also a locking or snap-in or similar unit 60 for releasably connecting housing 12 and lid 18.

The locking or snap-in or similar unit 60 comprises a detent 62 or the like which is disposed on the free end 64 of the lid 18 which is opposite to the hinged connection 34 between lid 18 and housing 12 and is adapted to be brought into engagement with a locking protrusion 66 or the like provided on the housing 12. The detent 62 or the like and the locking protrusion 66 or the like are substantially hook-shaped, the detent 62 or the like extending approximately in the direction of the hinged connection 34 between lid 18 and housing 12 while the locking protrusion 66 or the like extends approximately in opposite direction. Detent 62 and locking protrusion 66 abut each other via locking faces 68, 70 when they are in mutual functional engagement. In the drawings where a face or extended surface is identified by a number, line therefore is terminated in an inverted U-shaped illustration, with the ends of the U-shaped illustration abutting identified element for purposes of clarity. The two locking faces 68, 70 of detent 62 and locking protrusion 66, respectively, are disposed in a plane 72 which is perpendicular to the drawing plane, said plane 72 intersecting the horizontal plane 74, which is perpendicular on the drawing plane, at an angle $\alpha$ of from 15° to 75°, preferentially at an angle $\alpha$ of 45°, as will be apparent in detail from FIGS. 6 and 7.

Instead of the locking protrusion 66 or the like it is also possible to provide a locking recess (not illustrated) for receiving the detent 62 or the like. In that case the locking recess extends in correspondence with the detent 62 or the like approximately in the direction of the hinged connection 34 between lid 18 and housing 12. Furthermore, it is also possible to provide, instead of the detent 62 or the like, a locking recess (not illustrated) for receiving the locking protrusion 66 or the like. In that case the locking recess will extend in correspondence with the locking protrusion 66 or the like in a direction which is substantially opposite to the hinged connection 34.

The detent 62 or the like is disposed on an elastic web 78 or the like which in its turn is joined through a further elastic web 75 to the free end 64 of the lid 18. Specifically, the web 78 carrying the detent 62 or the like merges perpendicularly with the elastic web 75, as is clearly shown in FIG. 6. On account of such an elastic configuration the engagement and disengagement of detent 62 and locking protrusion 66 with each other and from each other, respectively, is greatly facilitated. This is additionally achieved by the feature that the web 75 or the like specifically extends approximately parallel to the plane 72 in which the locking faces 68, 70 of detent 62 and locking protrusion 66 are situated.

Figure 6:
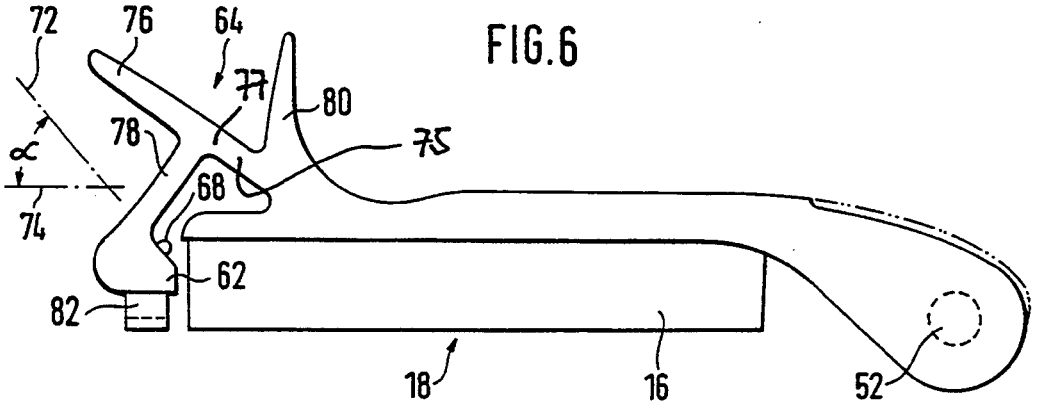
FIG. 6 is an enlarged side view of an embodiment of a lid of the manual filling device of the present invention as illustrated in FIGS. 1 to 5.

Moreover, as illustrated in FIG. 6, the free end 77 of the elastic web 75 or the like is provided with an operating lever 76 for lifting the detent 62 off the locking protrusion 66 and thus for simplified disengagement and/or engagement of the locking or snap-in or similar means 60 at the commencement of the filling operation and after completion thereof, respectively. The operating lever 76 extends beyond the free end 64 of the lid 18, preferentially it extends somewhat upwardly. As will be apparent from FIG. 6, the operating lever 76 extends substantially parallel to the plane 72 in which the locking faces 68, 70 are situated, and in particular it extends as a continuation of the further elastic web 75.

Moreover, the free end (64) of the lid 18 is provided with an additional, substantially vertically upwardly extending and essentially rigid web 80 or the like which is closely adjacent the web 75 and serves as a counter support for the actuating lever 76 as a continuation of the elastic web 75. Thus, the web 80 or the like offers an especially good hold to the user of the manual filling device 10 for effecting disengagement of the detent 62 and the locking protrusion 66 with the aid of the actuating lever 76 provided on the web 75. Consequently, the actuating lever 76 and/or the rigid web 80, which are formed on the lid 18 and hence on the bottom part 14 pivotally accommodating the same, together with the recessed grips 42 on the bottom part 14 prevent slipping of the user's hand during the actual filling operation.

The clamping unit 59 comprises a clamping member 82 which upon functional engagement of the locking or snap-in or similar means 60 is brought into close contact with the socket piece 50. In this way the cigarette (filter) tube is automatically clamped to the socket piece 50 for the entire duration of the actual filling operation, i.e. during all of the ejecting movement of the tobacco from the tobacco compression chamber. Specifically, the clamping member 82 is disposed on the free end 64 of the lid 18 opposite the hinged connection 34 between lid 18 and housing 12 and near the locking or snap-in or similar means 60, preferentially on the elastic web 78 which carries the detent 62 or the like. The clamping effect to be achieved by the clamping member 82 is additionally enhanced due to the fact that the clamping member 82 is elastic and, if desired, is made of soft plastics, rubber or the like.

As shown in FIG. 8, the sidewalls 38 of the bottom part 14 are provided with recesses 84 or the like in the central region and also in the region of the end 36 of the bottom part 14 adjacent the hinged connection between lid 18 and housing 12. Preferentially, the recessed portions 84 of the sidewalls 38 of the bottom part 14 are provided in the region between the hinged connection 34 between lid 18 and housing 12 and the recessed grips 42 or the like. As regards their height, the recesses 84 in the sidewalls 38 of the bottom part 14 reach close to the undercut portions 26 of the bottom part 14. The recesses 84 or the like in the two sidewalls 38 of the bottom part 14 provide for a considerable reduction in the net weight of the manual filling device 10. An additional reduction in net weight may be obtained by continuous recesses (not illustrated), i.e. by recesses extending from the recessed grips 42 or the like right to the hinged connection 34 of the lid 18 and the housing 12. In that case the approximately triangular portions 86 of the sidewalls 38 of the bottom part 18 will no longer be present.

All of the features disclosed in the present application papers are claimed as being essential for the invention to the extent to which they are novel either singly or in combination over the prior art.

I claim:

1. A manual filling device for cigarette tubes including cigarette filter tubes, comprising a bottom part (14), an elongated housing (12) mounted in said bottom part and having an elongated tobacco compression chamber having a first end and a second end and extending in a longitudinal direction between said first and second end, said chamber having an opening at said first end of said chamber, a socket piece secured to said opening and adapted to receive a cigarette tube, a lid (18) hinged to the housing (12) at said second end of said chamber for covering said chamber and extending from said second end to an outer free end (64), a pressing bar secured to said lid (18) for movement into said chamber, an ejector slide (22), a spoon coupled to said slide for ejecting a compressed tobacco bar from the tobacco compression chamber through said opening (24) and into a cigarette tube on said socket piece, a locking means (60) for releasably connecting said housing (12) and said lid (18) with said lid in the closed position, said locking means including an elastic web (78) having a substantially hook-shaped detent (62) connected to the free end (64) of said lid (18) and said detent extended rearwardly of said lid toward said second end of said chamber, said housing having a locking protrusion (16) extending forwardly of said lid, said detent adapted to be engaged with said locking protrusion (66) formed on the housing (12), and wherein the detent (62) extends approximately in the direction of the second end of said chamber while the locking protrusion (66) extends approximately in the opposite direction, further comprising the improvement in said locking means characterized in a second elastic web (75) connected to and extending laterally from said elastic web (78) and connected to the free end (64) of said lid (18), said second elastic web (75) having a free end (77), an actuating lever (76) connected to said second elastic web for raising the detent (62) off the locking protrusion (66) to thereby facilitate disengagement and/or engagement of the locking means (60).

2. The manual filling device as claimed in claim 1, characterized in that the actuating lever (76) extends outwardly beyond the free end (64) of the lid (18).

3. The manual filling device as claimed in claim 2, characterized in that the detent (62) and the locking protrusion (66) include interengageable locking faces located in a plane (72) in the locking position which intersects a plane (74) parallel to said elongated housing at an angle $\alpha$ of 15° to 75°.

4. The manual filling device as claimed in claim 2, or claim 3, characterized in that the actuating lever (76) extends substantially parallel to said plane (72).

5. The manual filling device of claim 1, characterized in that the web (78) extends perpendicularly to the second elastic web (75).

6. The manual filling device of claim 1, wherein an essentially rigid third web (80) is connected to the free end (64) of the lid (18) adjacent the second elastic web (75) and extends substantially outwardly in the opposite direction of said web (78).

7. The manual filling device of claim 1, including a clamping means (59) having a clamping piece (82) secured to the free end (64) of the lid (18) adjacent said locking means (60).

8. The manual filling device of claim 7, wherein said clamping piece (82) is formed of an elastic material.

9. The manual filling device of claim 1, wherein said housing (12) is movably mounted within said bottom part (14) for longitudinal movement therein, said ejector slide (22) being mounted on the bottom part (14), said spoon (20) being connected to said slide.

10. The manual filling device of claim 9, including a locking means (30–32) provided between said bottom part (14) and said housing (12).

11. The manual filling device as claimed in claim 10, wherein said housing (12) include a guide fin (28), at least one protrusion (30) disposed on said guide fin (28) of the housing (12) adjacent the end (36) of the lid (18) and said second end of said chamber (34) between lid (18) and housing (12), said bottom part (14) having an undercut portion (26) serving as guide means for said guide fin (28).

12. The manual filling device of claim 11, including a recess (32) in said undercut portion, and wherein said guide fin (28) includes said protrusion (30) constructed and adapted to snap into said recess (32).

13. The manual filling device of claim 11, wherein the cross-section of said bottom part (14) is a substantial U-shaped cross-section including two sidewalls (38), recessed grips (42) on said sidewalls (38) protruding into said U-shaped cross-section at said first end (40) and spaced from said second end.

14. The manual filling device of claim 13, wherein said sidewalls (38) of the bottom part (14) are provided with top recesses (84) in the vicinity of the end (86) of the bottom part (14) adjacent the hinged connection (34) between lid (18) and housing (12).

15. The manual filling device of claim 13, wherein said recesses (84) in the sidewalls (38) of the bottom part (14) include a continuous outer recess between the hinged connection (34) of lid (18) and housing (12) and the recessed grips (42).

16. The manual filling device of claim 15, wherein said bottom part (14) is provided with a further recessed portion (46) and the housing (12) is provided with a recessed portion (56).

* * * * *